United States Patent [19]

Ode et al.

[11] 4,210,798

[45] Jul. 1, 1980

[54] DEVICE FOR DETACHABLY MOUNTING GLASS ON TIMEPIECE CASES

[75] Inventors: Sadao Ode, Houya; Toshikazu Hatuse, Tanashi, both of Japan

[73] Assignee: Citizen Watch Co. Ltd., Tokyo, Japan

[21] Appl. No.: 902,945

[22] Filed: May 4, 1978

[30] Foreign Application Priority Data

Feb. 9, 1978 [JP] Japan ..... 53-13006

[51] Int. Cl.[2] ..... H05B 1/00

[52] U.S. Cl. ..... 219/243; 368/294; 156/583.7

[58] Field of Search ..... 219/243; 29/177; 156/344, 584, 583.1, 583.6, 583.7; 58/91

[56] References Cited

U.S. PATENT DOCUMENTS

| | | | |
|---|---|---|---|
| 1,620,597 | 3/1927 | Fontana | 156/583.6 |
| 2,532,501 | 12/1950 | Johnson | 219/243 X |
| 2,629,809 | 2/1953 | Frye | 219/243 X |
| 3,098,916 | 7/1963 | Souligney | 219/243 X |
| 3,372,081 | 3/1968 | Hurschman | 156/583.7 X |
| 3,445,913 | 5/1969 | Piguerez | 29/177 X |

*Primary Examiner*—C. L. Albritton

*Attorney, Agent, or Firm*—Sherman & Shalloway

[57] ABSTRACT

A device for automatically removing glass from timepiece cases and attaching the glass to the timepiece case again is disclosed. The device comprises a case holding frame disposed on a heater board and a push rod for pushing the glass upon the timepiece case, whereby the timepiece case is locally heated under pressure.

12 Claims, 5 Drawing Figures

DEVICE FOR DETACHABLY MOUNTING GLASS ON TIMEPIECE CASES

BACKGROUND OF THE INVENTION

1. Field of the Invention

This invention relates to a device for detachably mounting glass on timepiece cases in a mechanical manner with the aid of heat under pressure.

2. Description of the Prior Art

As one of means for securing glass to a timepiece case, heretofore it has been proposed to fit the glass in the timepiece case with a given gap formed therebetween and then to secure the glass to the timepiece case. Recently, a hard glass has often been used by taking its design into consideration or an excellent adhesive agent has been developed. As a result, means for firmly and adhesively bonding the glass to the timepiece case has been used in practice in place of mechanically securing the glass to the timepiece case. Such adhesive bonding means can prevent the glass from being broken and has an excellent workability. In such adhesive bonding means, the timepiece case as a whole is immersed in hot water for 30 minutes so as to deteriorate the adhesive agent and hence to remove the glass from the timepiece case. But, such adhesive bonding means has the disadvantage that since the timepiece case as a whole is immersed into and heated by hot water for 30 minutes the workability is adversely affected because silicon oil or the like injected into timepiece parts as a water proof packing, push button or the like is driven out of these parts, thereby rendering oil lubrication bad.

SUMMARY OF THE INVENTION

A main object of the invention, therefore, is to provide a device for detechably mounting glass on timepiece cases, which can eliminate the above mentioned drawbacks which have been encountered with the prior art techniques.

Another object of the invention is to provide a device for detachably mounting glass on timepiece cases, which can considerably shorten the time required for detachably mounting the glass on the timepiece case.

A further object of the invention is to provide a device for detachably mounting glass on timepiece cases, which can be adjusted in operation in response to configuration and diameter of glass to be detechably mounted on the timepiece case.

A still further object of the invention is to provide a device for detachably mounting glass on timepiece cases, which can adjust a heating temperature in response to a melting point of an adhesive agent for bonding glass to timepiece cases and hence there is no risk of the timepiece being over heated.

Another object of the invention is to provide a device for detachably mounting glass on timepiece cases, which can control pressure subjected to the glass.

A feature of the invention is the provision of a device for detachably mounting glass on timepiece cases, comprising a main body including a supporting member and a substrate, a heater board secured to said substrate and including a temperature control means, a case holding frame secured to said heater board and for holding a timepiece case including glass and a case, and a push rod movably supported by said supporting member of said main body and urging the glass against the timepiece case.

DETAILED DESCRIPTION OF PREFERRED EMBODIMENTS

Figure 2:
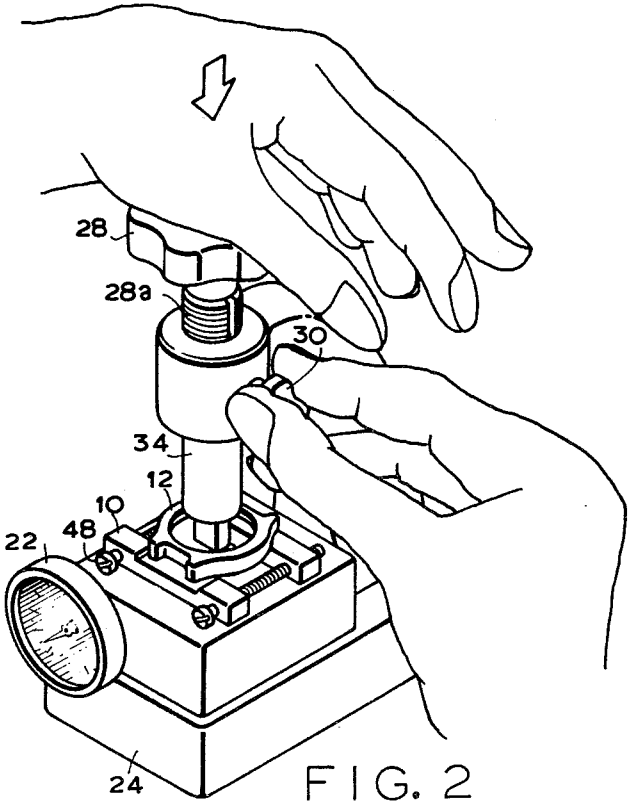
FIG. 2 is a perspective view for illustrating a mode of removing glass from a timepiece case.
Figure 1:
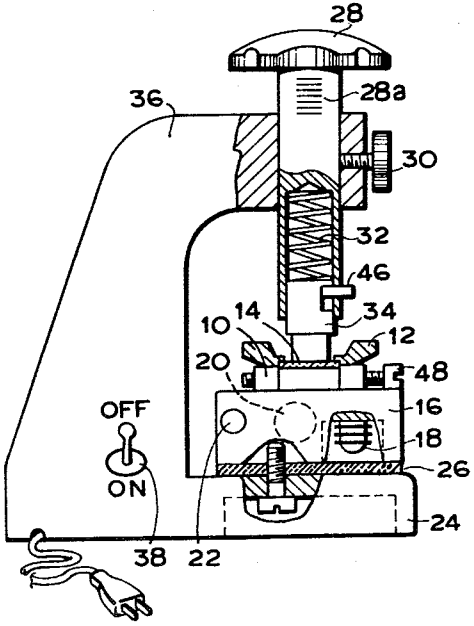
FIG. 1 is a front elevational view of a device for detachably mounting glass on timepiece cases according to the invention, partly shown in section.

The invention will now be described in greater detail with reference to the accompanying drawings. Referring to FIGS. 1 and 2 showing one embodiment of a device according to the invention as a whole, reference numeral 10 designates a case holding frame for holding a timepiece case 12. Provision may be made of a number of these case holding frames 10 which are matched with different configurations of the timepiece case 12 or glass 14. Alternatively, provision may be made of one universal case holding frame 10 that permits the holding of different configurations of the timepiece case 12 or glass 14. Reference numeral 16 designates a heater board including a heater 20 for heating the heater board. The heater board 16 functions to heat through the case holding frame 10 the timepiece case 12 so as to deteriorate an adhesive agent bonded to the periphery of the glass 14. Reference numeral 18 designates a thermostat for controlling a heating temperature of the heater board 16 and 22 a thermometer for checking the heating temperature of the heater board 16. The heater board 16 is secured through a heat resistant plate 26 to a substrate 24. The substrate 24 is provided at its one side with a bracket 36 made integral therewith and for supporting a push rod 28.

The bracket 36 is provided at its free end with a locking member such as a pressure adjustment screw 30 which functions to set a pressure subjected to the glass 14. The push rod 28 is provided therein with a cylindrical cavity for enclosing a spring 32 and an end tip 34 of the push rod 28 therein. The end tip 34 is prevented from removing out of the push rod 28 by means of a pin 46.

Figure 3:
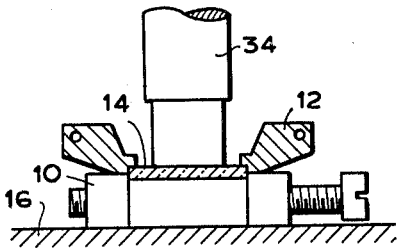
FIG. 3 is a front elevational view of main parts shown in FIG. 1 in an enlarged scale, partly shown in section.

FIG. 3 shows the above mentioned main parts of the device according to the invention in an enlarged scale, in which the same reference numerals designate the same parts shown in FIG. 1.

The device according to the invention may be operated as follows. The timepiece case 12 whose glass 14 is to be removed is mounted on the case holding frame 10. In this case, the timepiece case 12 may be secured to the case holding frame 10. alternatively, that portion of the timepiece case 12 which is exclusive of the glass 14 may be disposed on the case holding frame 10. Then, the push rod 28 is lowered down and brought into contact with the glass 14. The push rod 28 is then forcedly lowered down against the action of the spring 32. The pressure subjected to the glass 14 by the push rod 28 is read out by a scale division **28*a*. In the present test, let it be assumed that when the scale divison 28*a* shows 3 mm, it corresponds to 10 kg of the pressure subjected to the glass 14. Then, the push rod 28 is locked by fastening the pressure adjustment screw 30. When the above mentioned set has been completed, the glass 14** is subjected to a given pressure.

If an electric supply source switch 38 is made ON, the heater 20 is energized to gradually heat the heater board 16 which functions to heat through the case holding frame 10 the timepiece case 12.

If the temperature of the heater board 16 becomes about 180° C., the temperature of the timepiece case 12 becomes about 150° C., thereby softening the adhesive agent so that the glass 14 may be automatically removed downwardly from the timepiece case 12.

Experimental tests have shown the result that if the timepiece case 12 is heated to near 150° C. for about 5 to 6 minutes after the electric supply source switch 38 has been made ON, it is possible to remove the glass 14 downwardly from the timepiece case 12 within at most 10 minutes even when room temperature, bonding strength or the like are not uniform. As a result, the device according to the invention is far superior in workability to the conventional device for heating the timepiece case inclusive of the glass in the hot water. In addition, the use of a plurality of the devices according to the invention ensures an automatic removal of glass from timepiece cases with a considerably high efficiency.

Figure 4:
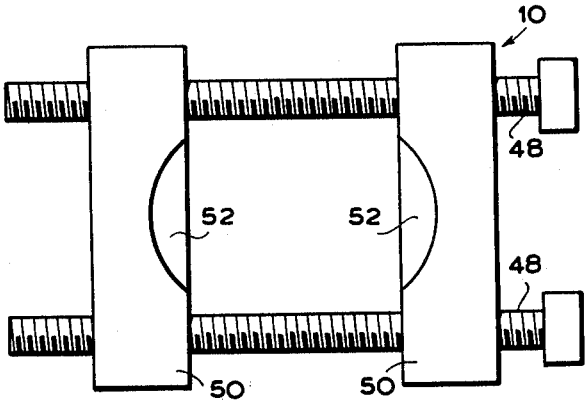
FIG. 4 is a plan view of a case holding frame shown in FIG. 1.

FIG. 4 is a plan view of the above mentioned case holding frame 10 in an enlarged scale. The case holding frame 10 is composed of a pair of spaced apart opposed parallel bar-shaped members 50, 50 and a pair of spaced apart opposed parallel screw members 48, 48 crossed perpendicular to said bar-shaped members, respectively. The screw members 48, 48 are rotated in response to the diameter of the glass 14 so as to adjust the distance between the bar-shaped members 50,50. The bar-shaped members 50,50 are provided at their upper opposed surfaces with arcuate depressions 52,52, respectively. These arcuate depressions 52,52 serve to accurately hold timepiece case 12 which is not provided a flat surface to be aligned with the case holding frame 10. The bar-shaped members 50,50 are not provided in the rear of the arcuate depressions 52,52 with corresponding arcuate depressions, and as a result, a timepiece case 12 having a flat peripheral surface can accurately be held by the case holding frame 10 which has been turned inside out.

Figure 5:
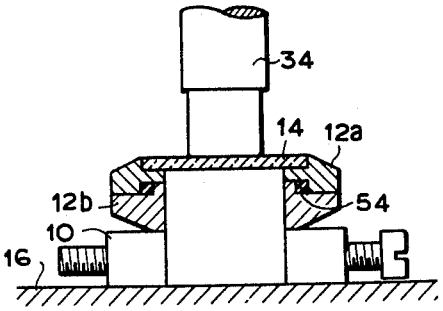
FIG. 5 is a front elevational view of modified main parts shown in FIG. 3 in an enlarged scale, a part being shown in section.

FIG. 5 shows a mode of using the device according to the invention for the purpose of attaching the glass to the timepiece case. In this case, the timepiece case is turned inside out as shown in FIG. 5 and then is disposed on the case holding frame 10. Subsequently, the glass 14 is heated under pressure so as to attach the glass 14 to the timepiece case 12. In the present embodiment shown in FIG. 5, a timepiece case 12 is composed of an upper half case portion **12*a* and a lower half case portion 12*b*. Between these upper and lower case portions 12*a*, 12*b* is sandwiched a packing 54**.

In the previous embodiments, the case holding frame 10 is independent of the heater board 16, but the case holding frame 10 may be made integral with the heater board 16.

As stated hereinbefore, the device according to the invention is capable of considerably shortening the operation time and is capable of locally heating the timepiece case, so that there is no risk of the timepiece case as a whole being heated and hence being changed in color or the like. In addition, the device according to the invention is capable of automatically removing the glass from the timepiece case and then can attach the glass to the timepiece case again.

What is claimed is:

1. A device for detachably mounting a glass on a timepiece case, comprising:

a. a main body including a supporting member and a substrate;

b. a heater board secured to said substrate and including a temperature control means;

c. a case holding frame disposed above said heater board in thermal contact therewith for holding the timepiece case; and d. a push rod adjustably supported by said supporting member of said main body for urging the glass toward or away from said timepiece case.

2. The device according to claim 1, wherein said case holding frame is provided with an opening and with means for adjusting the opening in accordance with the diameter of the glass.

3. The device according to claim 1, further including a force transmitting train comprising a spring within said push rod through which force is transmitted by said push rod to the glass.

4. The device according to claim 1, wherein said supporting member of said main body is provided with a lock member for locking said push rod in a given position.

5. The device according to claim 3, wherein said push rod is provided therein with an end for engaging the glass portion retained within a pin.

6. The device according to claim 1, wherein a periphery of said push rod is provided with a scale for showing the load applied to the glass.

7. The device according to claim 1, wherein said heater board is provided therein with a heater connected to an electric switch for connection to an electric supply.

8. The device according to claim 2, wherein said case holding frame comprises a pair of spaced apart opposed parallel bar-shaped members defining therebetween the opening and a pair of spaced apart opposed parallel screw members perpendicular to and engaging said bar-shaped members for adjusting the opening.

9. The device according to claim 8, wherein said bar-shaped members are provided at their opposed upper surfaces with depressions for receiving said timepiece case.

10. The device according to claim 1, wherein said supporting member of said main body comprises a bracket made integral with said substrate.

11. The device according to claim 1, wherein between said heater board and said substrate is sandwiched a heat resistant means.

12. The device according to claim 1, wherein said temperature control means comprises a thermostat.

* * * * *